US010822129B2

(12) United States Patent
Leap et al.

(10) Patent No.: US 10,822,129 B2
(45) Date of Patent: Nov. 3, 2020

(54) TEAR OPEN BAG

(71) Applicant: Automated Packaging Systems, LLC, Streetsboro, OH (US)

(72) Inventors: Ritchie Joan Leap, Ravenna, OH (US); Ryan Cantwell, Kent, OH (US)

(73) Assignee: Automated Packaging Systems, LLC, Streetsboro, OH (US)

( * ) Notice: Subject to any disclaimer, the term of this patent is extended or adjusted under 35 U.S.C. 154(b) by 0 days.

(21) Appl. No.: 15/997,758

(22) Filed: Jun. 5, 2018

(65) Prior Publication Data

US 2018/0354668 A1 Dec. 13, 2018

Related U.S. Application Data

(60) Provisional application No. 62/516,245, filed on Jun. 7, 2017.

(51) Int. Cl.

| | |
|---|---|
| ***B65B 43/26*** | (2006.01) |
| ***B65B 43/16*** | (2006.01) |
| ***B65B 61/12*** | (2006.01) |
| ***B65D 33/00*** | (2006.01) |
| ***B65B 43/12*** | (2006.01) |
| ***B65B 5/04*** | (2006.01) |
| ***B65B 61/04*** | (2006.01) |
| ***B65B 51/14*** | (2006.01) |
| ***B65D 75/58*** | (2006.01) |
| *B65B 25/14* | (2006.01) |

(52) U.S. Cl.

CPC ..... *B65B 43/267* (2013.01); *B65B 5/045* (2013.01); *B65B 43/123* (2013.01); *B65B 43/16* (2013.01); *B65B 51/146* (2013.01); *B65B 61/04* (2013.01); *B65B 61/12* (2013.01); *B65D 33/002* (2013.01); *B65D 75/5805* (2013.01); *B65B 25/141* (2013.01)

(58) Field of Classification Search

CPC ..... B65B 43/267; B65B 5/045; B65B 43/123; B65B 43/16; B65B 51/146; B65B 61/04; B65B 61/12; B65D 33/002; B65D 75/5805

USPC ..... 383/37, 77, 14, 207, 209

See application file for complete search history.

(56) References Cited

U.S. PATENT DOCUMENTS 3,162,353 A * 12/1964 Sylvester ..... B65D 75/5805 383/209
3,254,828 A 6/1966 Lerner
4,201,029 A 5/1980 Lerner
4,550,831 A 5/1985 Whitford
(Continued)

OTHER PUBLICATIONS

International Search Report and Written Opinion from PCT/US18/35939 dated Sep. 18, 2018 (11 pages).

*Primary Examiner* — Jes F Pascua
(74) *Attorney, Agent, or Firm* — Jon M. Isaacson

(57) ABSTRACT

An exemplary web of preformed bags includes first and second layers, first and second side, first and second side seals proximate the first and second edges, a plurality of transverse seals extending between the first and second side edges, an opening in the first layer, and a line of separation in the second layer, a first line of weakness in the first layer. The first line of weakness has a plurality of gaps having no perforations in a region between the plurality of openings in the first layer and the plurality of traverse seals.

19 Claims, 19 Drawing Sheets

(56) References Cited

U.S. PATENT DOCUMENTS

| | | | | |
|---|---|---|---|---|
| 4,863,285 | A * | 9/1989 | Claxton | B65D 31/00 383/37 |
| 5,007,744 | A | 4/1991 | Scarberry et al. | |
| 5,118,202 | A * | 6/1992 | Bruno | B65B 43/123 383/203 |
| 8,317,765 | B2 * | 11/2012 | Loyd | A61F 13/5518 604/385.02 |
| 2004/0162205 | A1 * | 8/2004 | Baker | B65D 31/00 383/37 |
| 2005/0063618 | A1 * | 3/2005 | Lorsch | B65D 75/40 383/38 |
| 2005/0254731 | A1 | 11/2005 | Berbert et al. | |
| 2013/0341237 | A1 | 12/2013 | Krumme | |
| 2015/0158628 | A1 | 6/2015 | Walsh | |

* cited by examiner

TEAR OPEN BAG

RELATED APPLICATION

The present application claims the benefit of U.S. Provisional Patent Application Ser. No. 62/516,245, filed on Jun. 7, 2017, titled "Tear Open Bag," which is incorporated herein by reference in its entirety.

TECHNICAL FIELD

The present application relates generally to packaging and in particular to preformed bags, a web of preformed bags, and methods of forming and using a web of preformed bags.

BACKGROUND OF THE INVENTION

U.S. Pat. No. 3,254,828, issued Jun. 7, 1966, to Hershey Lerner under the title Flexible Container Strips is directed to so called bags on a roll (here the AutoBag patent). U.S. Pat. No. 3,254,828 is incorporated herein by reference in its entirety. This patent discloses a web of bags interconnected by lines of weakness, preferably in the form of perforations, with each of the bags being open on one face. In use the bags are sequentially fed to a loading station. When at the loading station, each bag is blown open, a product is inserted and thereafter separated from the web and, if desired, the bag is then sealed to form a package.

These container strips in the form of chains of pre-opened bags are supplied either on a roll as taught in the AutoBag patent or festooned in a carton in the manner taught in U.S. Pat. No. 4,201,029, issued May 6, 1980, to Bernard Lerner et al. under the title Method and Apparatus for Packaging, (herein the Wig-Wag patent). Such container strips have been sold by Automated Packaging Systems, Inc. of Streetsboro, Ohio, the assignee of the present case, under the trademark AutoBag and have enjoyed great commercial success.

SUMMARY

Exemplary embodiments of webs of preformed bags and methods of forming the same are disclosed herein.

An exemplary web of preformed bags includes first and second layers. The layers are joined at or near first and second side edges. A plurality of transverse seals extend between the joining at or near the first and second side edges. The first layer has a plurality of openings between the first and second side edges. The second layer has a plurality of lines of separation between the first and second side edges. Parallel and overlying lines of weakness are disposed in the first and second layers near one of the side edges to allow the bags to be opened. The parallel lines of weakness are parallel to the first and second side edges. The lines of weakness have gaps with no perforations in at least a region between the plurality of openings in the first layer and the plurality of traverse seals. Each preformed bags is defined by the first and second side edges, one of the openings in the first layer, one of the lines of separation in the second layer, and one of the traverse seals. In use, the gaps prevent the lines of weakness from tearing when the bags are opened by a bagging machine.

BRIEF DESCRIPTION OF THE DRAWINGS

These and other features and advantages of the present invention will become better understood with regard to the following description and accompanying drawings in which.

DETAILED DESCRIPTION

Figure 1C:
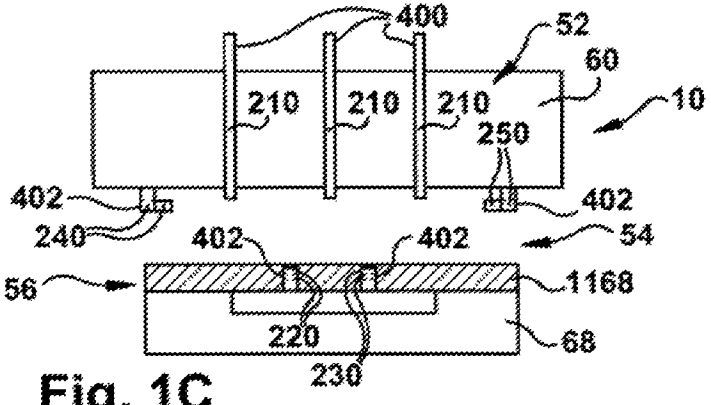
FIG. 1C is a top view of the apparatus shown in FIG. 1A.

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

The present application relates to an elongated web 16 (FIGS. 14-16) of preformed interconnected bags 18. In an exemplary embodiment, the web 16 has an opening 30 defined in a first ply 20 and a line of separation 32 in a second ply 22. The webs 16 of preformed interconnected bags 18 can take a wide variety of different forms. In the exemplary embodiments, illustrated by FIGS. 14-15, each preformed bag 18 is defined by first and second plies 20, 22 of the web 16. First and second side edges 24, 26 of the web hermetically join the first and second plies. Preformed seals 28 extend between the first and second side edges 24, 26. The opening 30 extends between the first and second side edges 24, 26. The line of separation 32, such as a line of perforations in the second ply 22 extends between the first and second side edges 24, 26. In one exemplary embodiment, the opening 30 is superposed over the line of perforations 32. In another exemplary embodiment, the opening 30 and the line of perforations 32 are offset.

In order to facilitate easy opening of the assembled package 12 by the end user, the first and second parallel lines of weakness 120, 220 are placed in the first and second plies 20,22. In the illustrated embodiment, the first parallel line of weakness 120 is in the first ply 20 and the second parallel line of weakness 220 is in the second ply 22. The illustrated parallel lines of weakness are parallel to the first and second side edges 24, 26. In other exemplary embodiments, the lines of weakness are substantially parallel to the first and second side edges 24, 26. In other exemplary embodiments, the lines of weakness are not parallel to the first and second side edges 24, 26. In other exemplary embodiments, one example of which is illustrated in FIG. 14A, the first parallel line of weakness 120 is placed in the first ply 20 without a second parallel line of weakness 220 in the second ply 22. In other exemplary embodiments, the second parallel line of weakness 220 is placed in the second ply 22 without a first parallel line of weakness 120 in the first ply 20. The first and second parallel lines of weakness 120, 220 can be composed of perforations, score lines, or any other detachable configuration. In the embodiment illustrated in FIG. 14, the lines of weakness overlie one another. However, in other exemplary embodiments, one example of which is illustrated in FIG. 14B, the lines of weakness in the first and second layer can be offset from one another.

The first and second parallel lines of weakness may extend the entire length of the web 120, 220. However, lines of weakness that extend the entire length of the web can separate or partially detach when the bags 18 are processed to form packages 12 from an elongated web 16 of preformed interconnected bags 18. Thus, when the bags of the web are opened (i.e. at opening 30) for filling with a package in the manner described below (i.e., in an apparatus 10 or packaging machine for making packages 12), the lines of weakness formed along the entire length of the web can inadvertently tear near the opening 30 due to stress placed on the lines of weakness by the opening mechanism. This results in a package that is opened or partially opened before it is sent to the customer.

In the present disclosure, the first and second parallel lines of weakness 120, 220 have a first gap 100 and/or a second gap 200 therein (a stronger solid area). These gaps 100 and/or 200 prevent the bagging machine from tearing open the lines of weakness 120, 220 when opening the bag for loading a product through the opening 30. Preferably, the gap is in both plies and the gaps in each ply are aligned. However, in other embodiments, the gap 100 may exist in the first ply 20 without having a gap 200 present in the second ply 22 or the gap 200 may exist in the second ply 22 without having a gap 100 present in the first ply 20.

Figure 14:
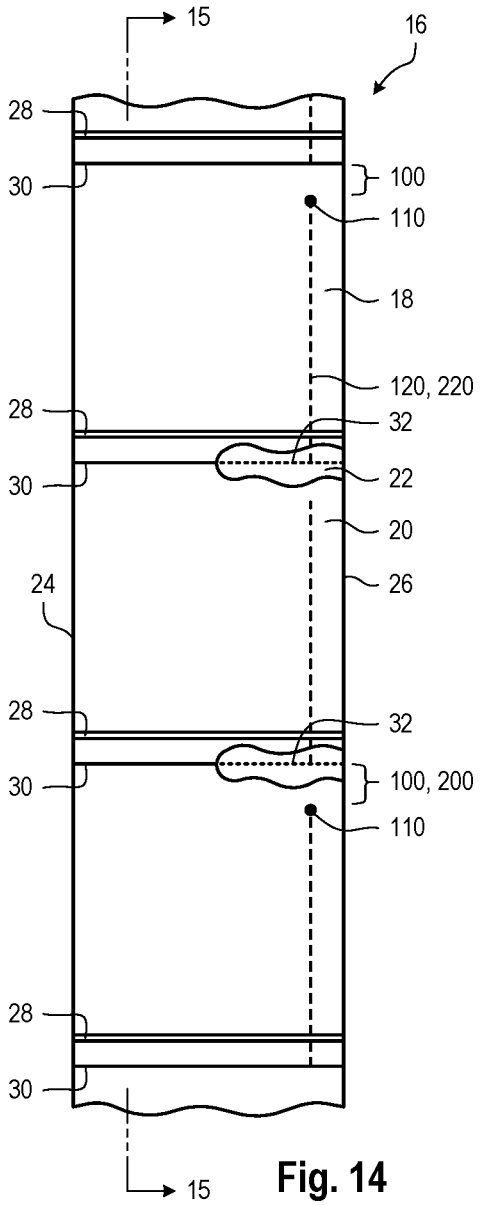
FIG. 14 is a view, partially cut away, of an elongated web of bags.
Figure 14A:
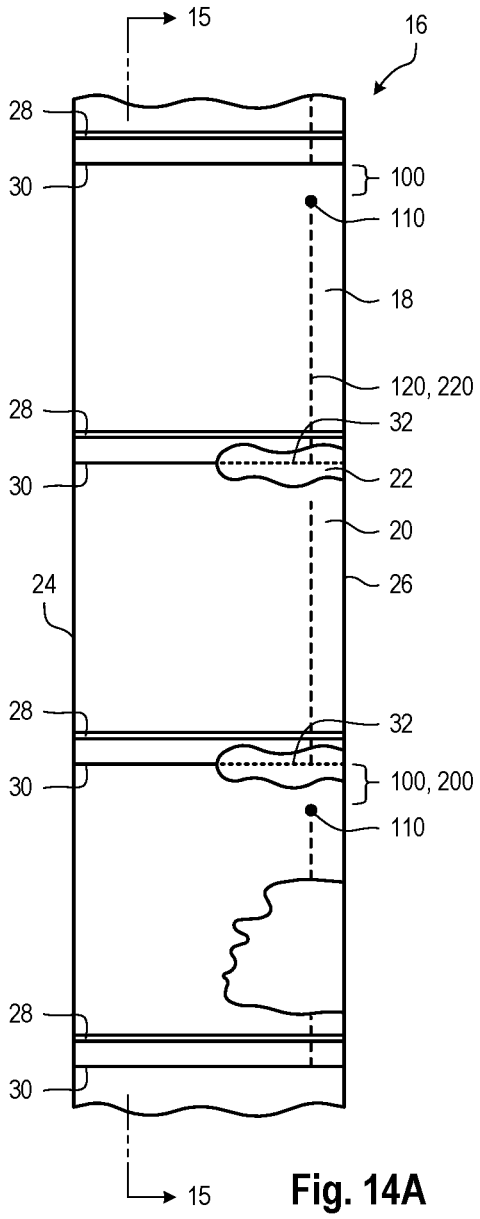
FIG. 14A-14B are views, partially cut away, of an elongated web of bags.
Figure 14B:
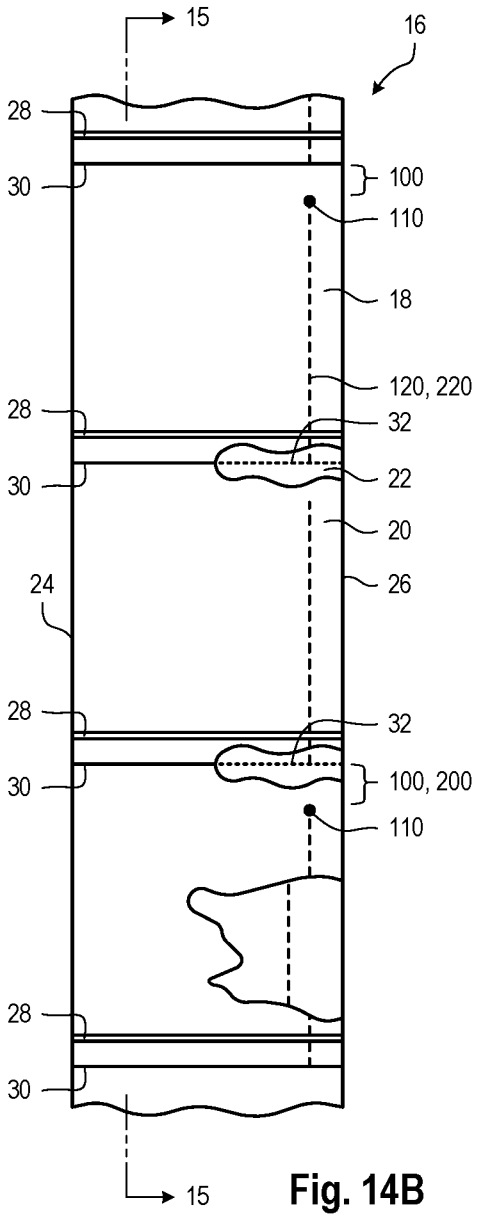
Figure 16:
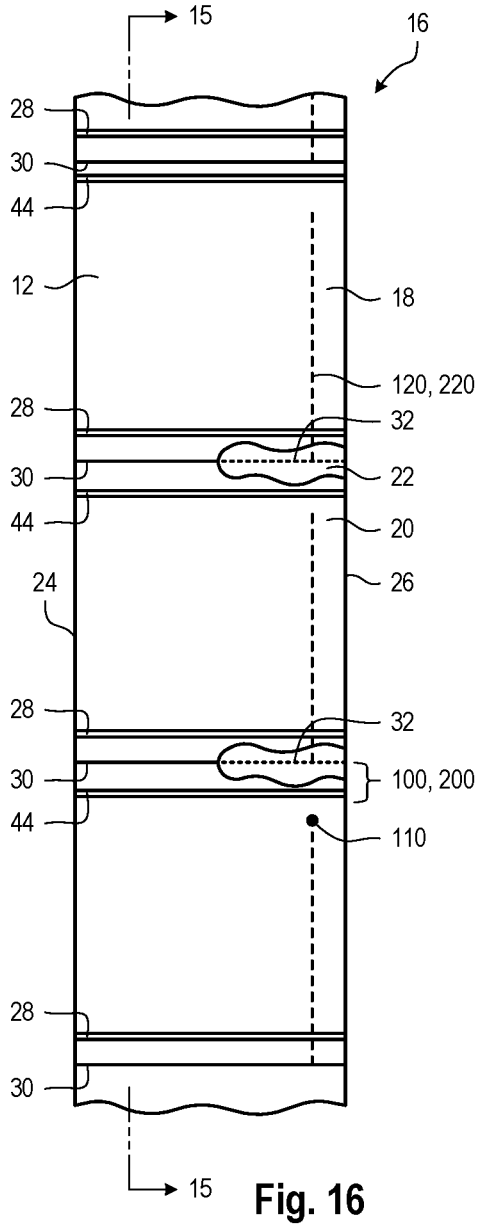
FIG. 16 is a view, partially cut away, of an elongated web of bags.

As illustrated in FIGS. 14 and 16, the first and second parallel lines of weakness 120, 220 have no perforations in the gaps 100, 200. In other embodiments perforations may be included in the areas 100, 200, but the perforations are configured such that the areas 100, 200 are stronger than the areas 120, 220 (i.e. the force required to tear open the areas 100, 200 is greater than the force required to tear open the areas 120, 222).

The combination of the gap 100 and/or the gap 200 and the lines weakness 120, 220 allows the end user to readily remove the product 40 from the package 12 by separating the bag at the line of weakness 120, 220 (see FIG. 17A), while facilitating smooth and interruption-free opening of the bags in the machine 10 by preventing the lines of weakness from tearing near the opening 30.

In the illustrated example, the first and second lines of weakness 120, 220 have a first gap and a second gap 100, 200 that prevent the first and second lines of weakness 120, 220 from intersecting the plurality of post formation seals 44. That is, the lines of weakness 120, 220 end before the position where the closing seal will be formed by the bagging machine. For example, the seal that closes the bag to form the package will be formed across the gap 100, 200, which is above the lines of weakness 120, 220. In other embodiments the seal that closes the bag to form the package will be formed outside of the gap 100, 200 and intersect the line of weakness 120, 220.

The gaps 100, 200 can take a wide variety of different forms. For example, in the illustrated example, the gap 100 having no perforations can extend into the area between the opening 30 in the first layer 20 to a point 110 at or before the preformed seal 28. Similarly, the gap 200 having no perforations can extend into the area between the lines of separation 32 in the second layer 22 to a point 110 at or before the preformed seal 28. The gap can exist in the first layer, the second layer, or both.

Line of weakness starting point 110 can be located anywhere along the sides 24, 26 of the bag. In certain embodiments, point 110 is 0.1 inch to 6 inches below the opening 30 or line of separation 32, including without limitation, 0.1 inch to 5 inches, 0.1 inch to 4 inches, 0.1 inch to 3 inches, 0.1 inch to 2 inches, 0.1 inch to 1 inch, less than 5 inches below the opening or line of separation, less than 4 inches below the opening or line of separation, less than 3 inches below the opening or line of separation, less than 2 inches below the opening or line of separation, less than 1 inch below the opening or line of separation, etc.

The gap 100 can be any suitable length. In certain embodiments, the gap 100 is 0.1 inch to 6 inches in length, including without limitation, 0.1 inch to 5 inches, 0.1 inch to 4 inches, 0.1 inch to 3 inches, 0.1 inch to 2 inches, 0.1 inch to 1 inch, less than 5 inches, less than 4 inches, less than 3 inches, less than 2 inches, less than 1 inch, etc. The gap 200 can be any suitable length. In certain embodiments, the gap 200 is 0.1 inch to 6 inches in length, including without limitation, 0.1 inch to 5 inches, 0.1 inch to 4 inches, 0.1 inch to 3 inches, 0.1 inch to 2 inches, 0.1 inch to 1 inch, less than 5 inches, less than 4 inches, less than 3 inches, less than 2 inches, less than 1 inch, etc.

In certain embodiments, the gap 100, 200 is less than one-half of the length of the preformed bag, including without limitation, less than one-quarter, less than one-eighth, less than one-sixteenth, etc. In certain embodiments, the gap 100, 200 is less than the length of the preformed bag but is greater than one-half of the length of the preformed bag, including without limitation, greater than three-quarters length of the preformed bag, greater than five-eighths length of the preformed bag, greater than six-eighths length of the preformed bag, etc. In the illustrated embodiment, the gap 100, 200 is in an upper portion of the bag. However, in certain embodiments, the gap 100, 200 can exist in any suitable place along the line of weakness, including without limitation, in the middle portions, bottom portions, or any variation in between the middle and bottom portions. In the illustrated embodiment there is only one gap in the line of weakness 120, 220. However, any number of gaps along the line of weakness may be present, including without limitation, 1-2 gaps, 2-4 gaps, 4-5 gaps, etc.

Figure 15:
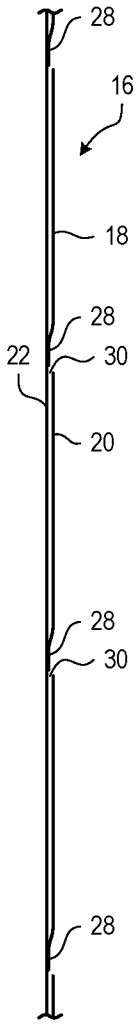
FIG. 15 is a sectional view taken along the plane indicated by lines 15-15 in FIG. 14.

The web 16 of preformed bags 18 illustrated by FIGS. 14-16 is one example of the wide variety of different webs that may be used. Examples of acceptable webs of preformed interconnected bags include, but are not limited to, the webs disclosed in U.S. Pat. No. 3,254,828 to H. Lerner and U.S. Pat. No. 5,957,824 to B. Lerner et al., which are incorporated herein by reference in their entirety.

The web 16 may be formed of any suitable material. Examples of suitable materials include, but are not limited to, plastic materials, polyethylene, cellophane, vinyl films, pliofilms, cellulose acetate film, polystyrene, polypropylene, and any heat sealable material.

Figure 17:
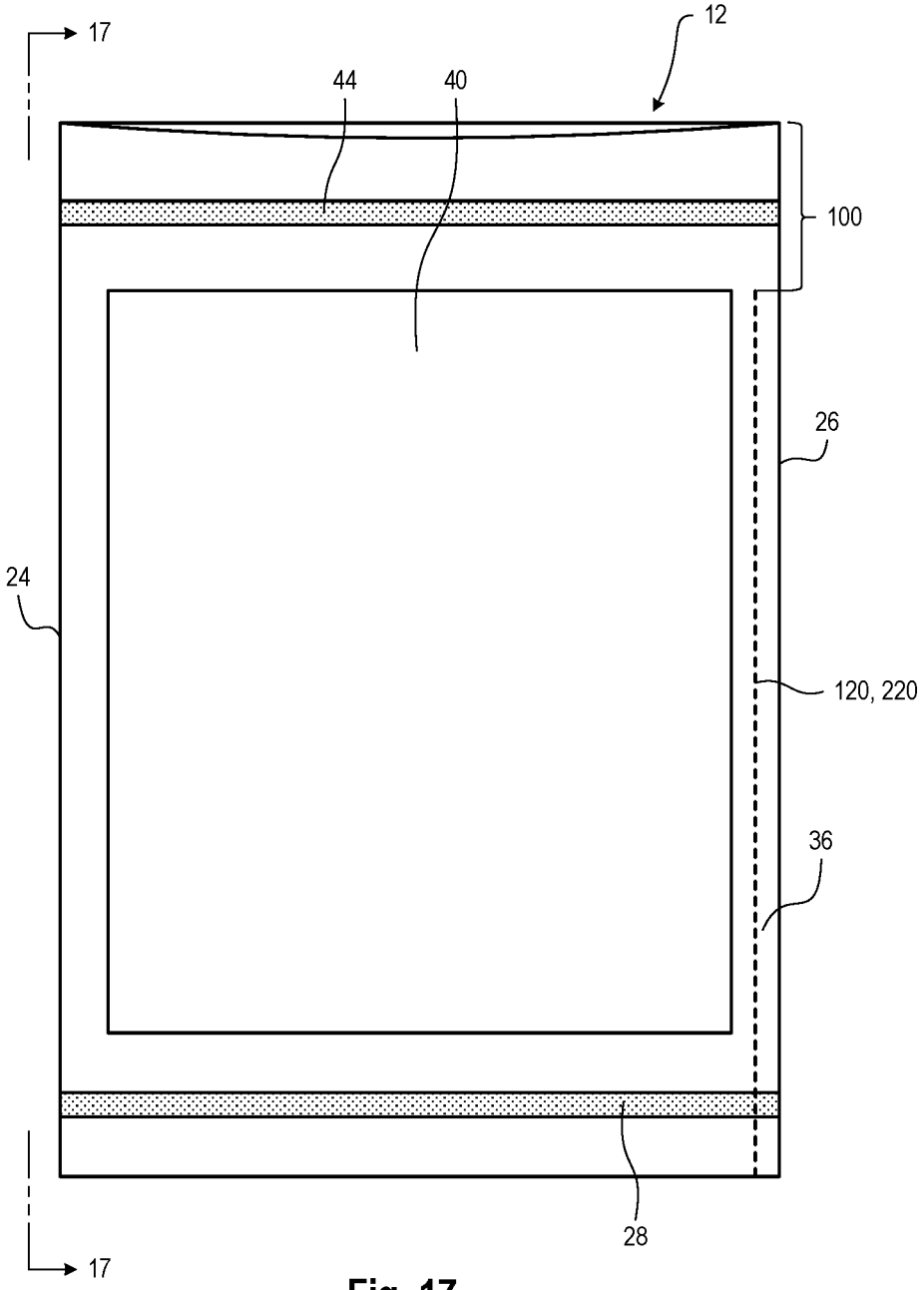
FIG. 17 is a front view of an exemplary embodiment of a package.
Figure 17A:
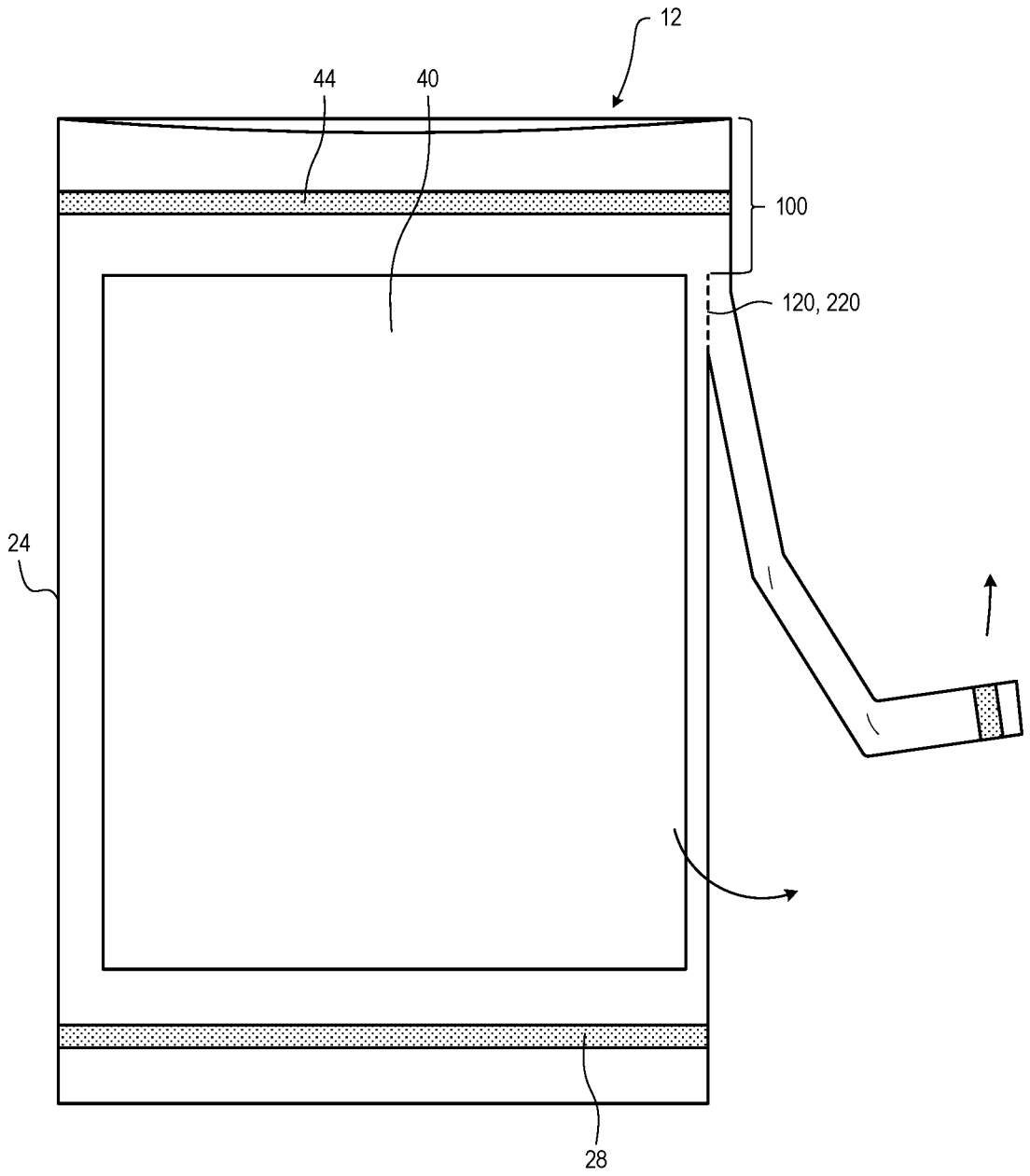
FIG. 17A is a front view of an exemplary embodiment of a package.
Figure 18:
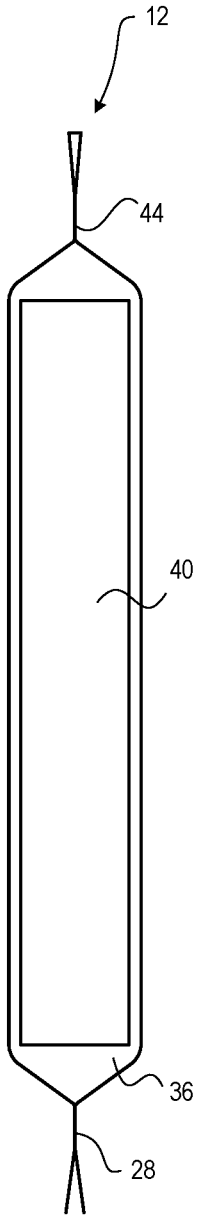
FIG. 18 is a view taken along the plane indicated by lines 17-17 in FIG. 17.

Referring to FIGS. 17, 17A, and 18, an exemplary package 12 includes a sealed compartment 36. The package 12 may have any number of compartments. Product 40 is disposed in the compartment 36. The illustrated product 40 is a box. However, the package 12 may contain any product. The compartment is defined by the first and second side edges 24, 26, the preformed seal 28, and an post formation seal 44 that is formed after the product 40 is loaded into the bag. In the example, the post formation seal 44 extends from the first side edge 24 to the second side edge 26 to hermetically seal the compartment 36. In another embodiment, the preformed seal 28 may not extend all the way from the first side edge to the second side edge or may be intermittent to allow communication between the compartment 36 and external air or the compartment 36 and another optional compartment of the package. The webs 16 of interconnected bags 18 can be made in a wide variety of different ways.

Figure 1A:
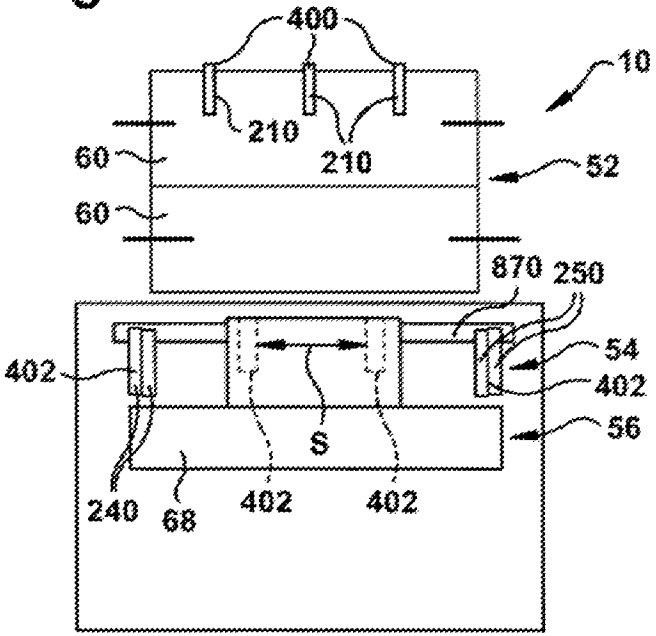
FIG. 1A is a front view of an exemplary apparatus for making packages from an elongated web of preformed interconnected bags.
Figure 1B:
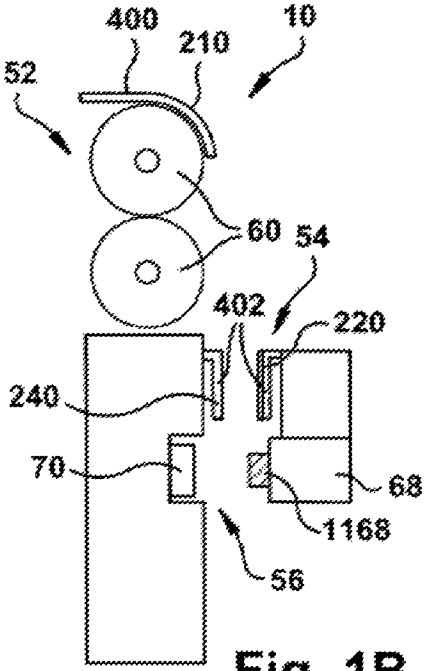
FIG. 1B is a side view of the apparatus shown in FIG. 1A.

The webs 16 of interconnected bags 18 can be used in a wide variety of different applications. For example, the webs 16 of interconnected bags 18 can be used in a wide variety of different packaging machines. FIGS. 1A-1C illustrate an exemplary embodiment of an apparatus 10 or packaging machine for making packages 12 from an elongated web 16 of preformed interconnected bags 18, such as the elongated webs 16 of bags 18 illustrated by FIGS. 14 and 15.

FIGS. 1A-1C through 13A-13C schematically illustrate an exemplary embodiment of a machine being operated to make packages 12 from an elongated web 16 of preformed interconnected bags 18. Any apparatus represented by the schematic illustrations of 1A-1C through 13A-13C can be used that performs the functions shown by FIGS. 1A-1C through 13A-13C. The concepts of the apparatus 10 can be implemented in any of a wide variety of packaging machines. For example, U.S. Pat. No. 3,254,468 to H. Lerner, U.S. Pat. No. 4,928,455 to Gereby et al., U.S. Pat. No. 5,341,625 to Kramer, U.S. Pat. No. 5,394,676 to B. Lerner et al., U.S. Pat. No. 6,543,201 to Cronauer et al., U.S. Pat. No. 6,742,317, U.S. Pat. No. 5,394,676, U.S. Pat. No. 5,371,521, and U.S. Pat. No. 4,899,520 disclose packaging machines that can be modified in accordance with the present invention to make packages from an elongated web of preformed interconnected bags and are all incorporated herein by reference in their entirety.

Figure 2C:
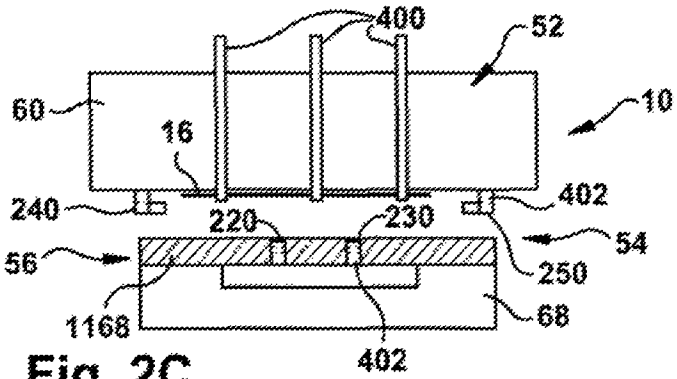
FIG. 2C is a top view of the apparatus and elongated web shown in FIG. 2A.
Figure 2A:
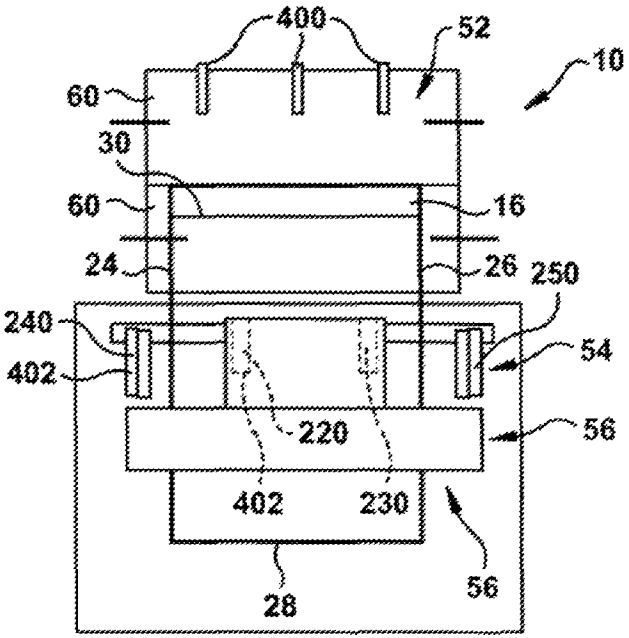
FIG. 2A is a front view of the apparatus showing the elongated web being advanced through the apparatus.
Figure 2B:
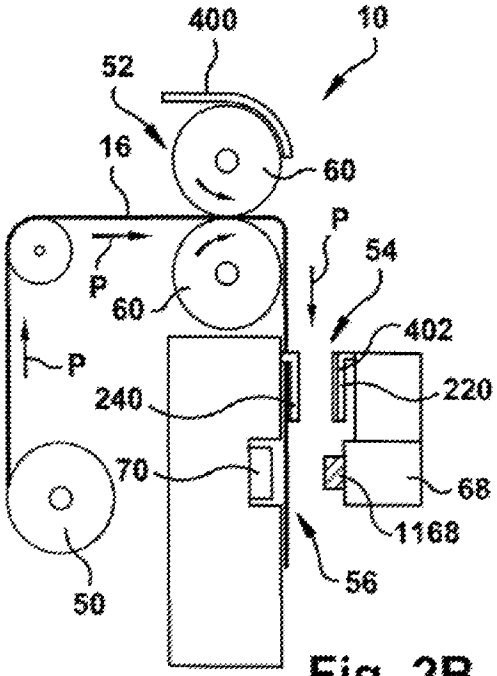
FIG. 2B is a side view of the apparatus and elongated web shown in FIG. 2A.
Figure 3C:
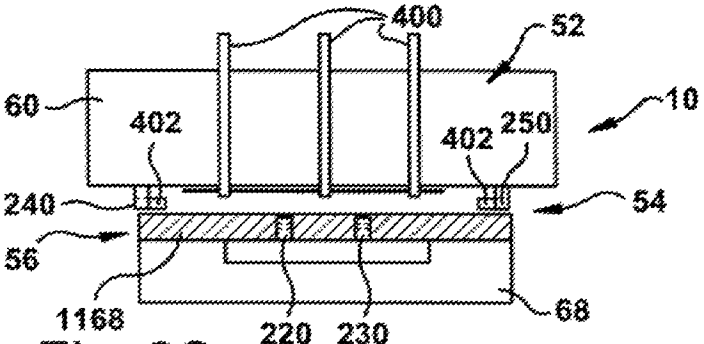
FIG. 3C is a top view of the apparatus and elongated web shown in FIG. 3A.
Figure 3A:
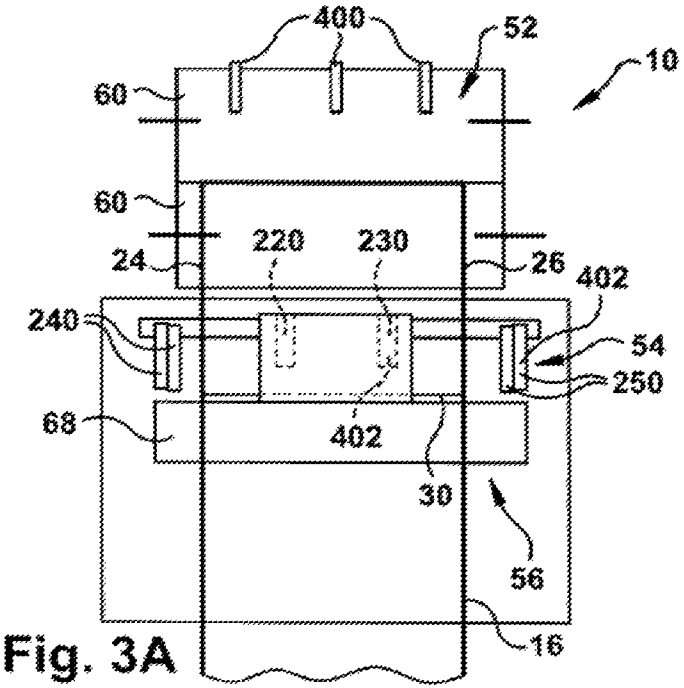
FIG. 3A is a front view of the apparatus showing the elongated web opening being positioned below a bag opening arrangement of the apparatus.
Figure 3B:
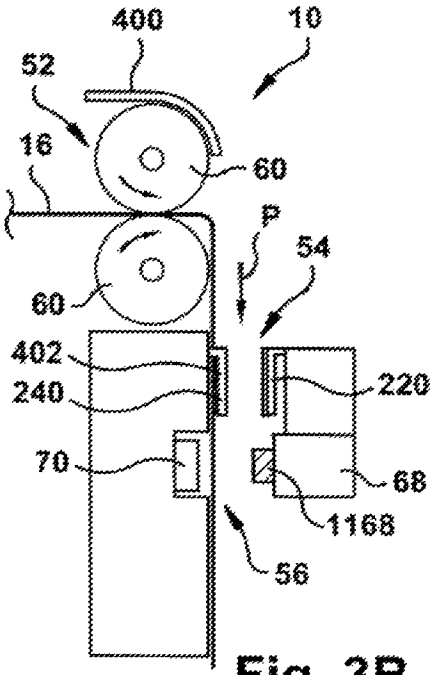
FIG. 3B is a side view of the apparatus and elongated web shown in FIG. 3A.

Referring now to FIGS. 1A-1C, the illustrated apparatus 10 includes a supply 50 (FIG. 2B) of the elongated web 16 of preformed interconnected bags 18, an indexing mechanism 52, an opening arrangement 54, a sealing arrangement 56, and a controller (not shown). The supply 50 comprises the elongated web 16 that is rolled or folded to stage a relatively large amount of the web in a relatively small space. The web 16 is routed from the supply 50 along a path of travel P to the indexing mechanism 52. The indexing mechanism 52 receives the web 16 from the supply and moves the web along the path of travel P. The indexing mechanism 52 may take a wide variety of different forms.

For example, any indexing mechanism that can be controlled to index bags of the web to selected positions along the path of travel may be used. In the illustrated example, the indexing mechanism comprises a pair of rollers 60 that form a nip that engages the web 16. The rollers 60 are selectively driven by a motor (not shown) to index bags of the web to selected positions along the path of travel P.

Referring to FIGS. 1A-1C, the opening arrangement 54 is positioned along the path of travel P to open each bag that is to be loaded and sealed. In the illustrated embodiment, the opening arrangement 54 comprises a blower 400 and an engagement device 402. However, the opening arrangement 54 may take a wide variety of different forms. The blower 400 can take a wide variety of different forms. In the illustrated embodiment, the blower 400 comprises a plurality of nozzles 210 positioned above the rollers 60 of the indexing mechanism 52. The illustrated nozzles 210 are oriented downward to blow air downward past the rollers 60 along the path of travel P of the web 16.

The engagement device 402 can take a wide variety of different forms. In the illustrated embodiment, the engagement device 402 comprises a first pair of grippers 220 and a second pair of grippers 230. The first pair of grippers 220 are spaced apart from the second pair of grippers 230 and both are configured to grip the first ply 20 of the bag 18. In one exemplary embodiment, the spacing S (FIG. 1A) between the grippers 220, 230 is adjustable. This optional spacing may be automatic and controlled by the controller or the spacing may be manually adjusted. This allows the engagement device to provide openings 800 (See FIG. 8) having different widths.

The engagement device 402 also includes a third pair of grippers 240 and a fourth pair of grippers 250. The third pair of grippers 240 and the fourth pair of grippers 250 are moveable relative to one another and are configured to grip the side edges 24, 26 of the bag 18. The third and fourth pairs of grippers 240, 250 are omitted from FIGS. 11B, 12B, and 13B to more clearly illustrate opening of the first and second pairs of grippers 220, 230.

The grippers 220 and 230 grip the opening 30 and move to create the rectangular opening 800 as will be described in more detail below. This rectangular opening allows the large items, such as rectangular items, like boxes to be packaged inside the bag 18. While the opening 800 is shown as a rectangular shape, the opening can be any shape. For example, the opening could be a quadrilateral, a trapezoid, a triangle, or any other shape. The number of grippers used to grip the opening 30 of the bag may be increased or decreased to create the desired opening shape. Different shape openings accommodate different shape packages being inserted into the bags.

Referring to FIGS. 1A-1C, the controller is in communication with the indexing arrangement 52, the opening arrangement 54, and the sealing arrangement 56. The controller controls the indexing arrangement 52, the opening arrangement 54, and the sealing arrangement 56 to convert the preformed bags 18 into packages 12. A wide variety of controllers can be used and programmed to control the indexing arrangement 52, the opening arrangement 54, and the sealing arrangement 56 as described herein. For example, the controller and controller algorithms described in U.S. Pat. No. 5,341,625 to Kramer can be modified to control the indexing arrangement 52, the opening arrangement 54, and the sealing arrangement 56 to form the packages.

Referring to FIGS. 2A-2C and 3A-3C, the controller controls the indexing mechanism 52 to index the web 16 forward along the path of travel as indicated by arrows P, until the opening 30 of the bag 18 is just below the engagement device 402 in the exemplary embodiment. In alternate embodiments, the opening 30 is indexed to other positions. For example, the opening 30 can be indexed to any position where the blower 400 can blow the opening 30 open or at least partially open. For example, the opening 30 may initially be positioned above the engagement device 402, be blown open by the blower 400, and then be moved to the position illustrated by FIGS. 3A-3C.

Figure 4C:
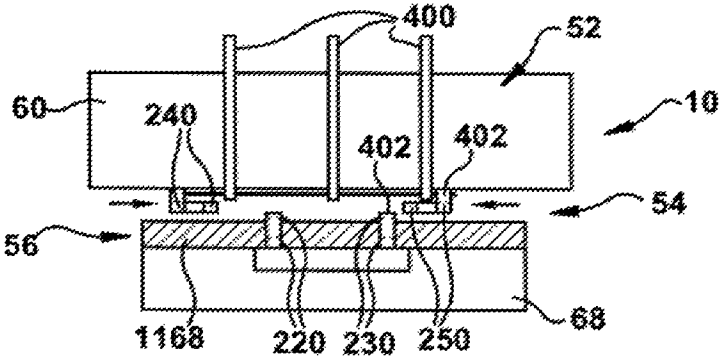
FIG. 4C is a top view of the apparatus and elongated web shown in FIG. 4A.
Figure 4A:
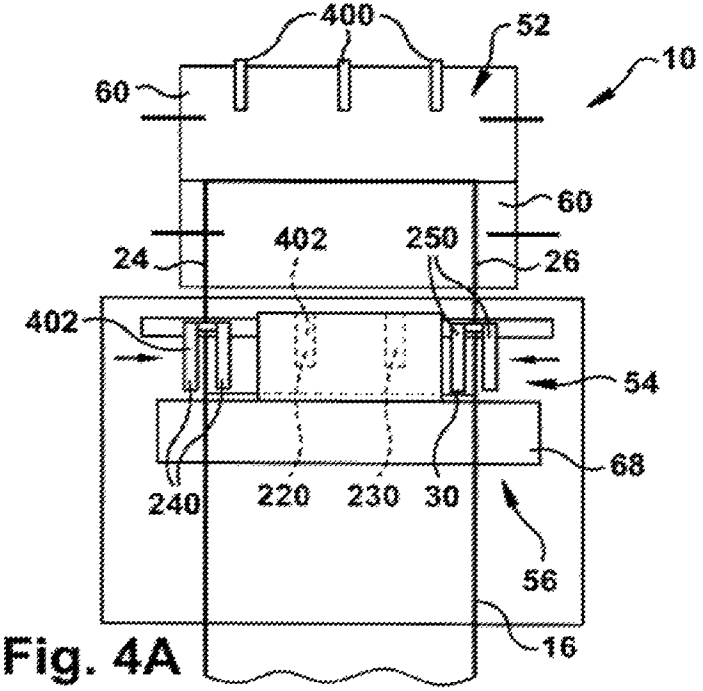
FIG. 4A is a front view of the apparatus showing bag engagement devices moved into position above the elongated web opening.
Figure 4B:
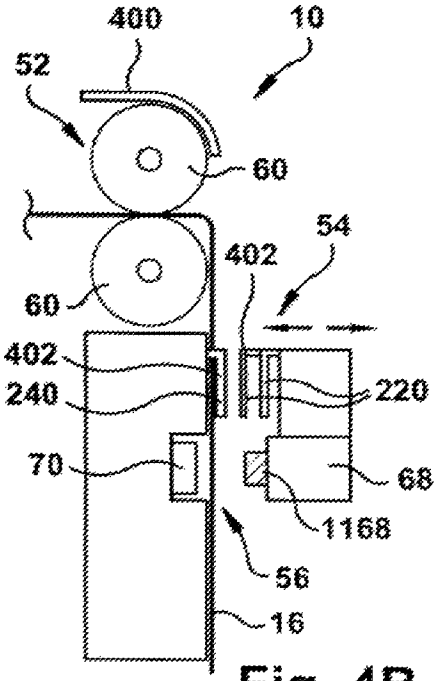
FIG. 4B is a side view of the apparatus and elongated web shown in FIG. 4A.
Figure 5C:
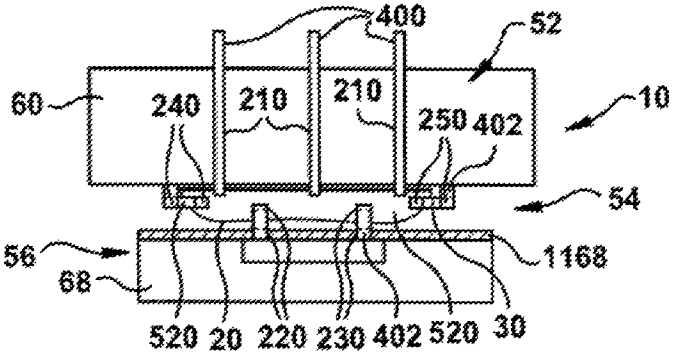
FIG. 5C is a top view of the apparatus and elongated web shown in FIG. 5A.
Figure 5A:
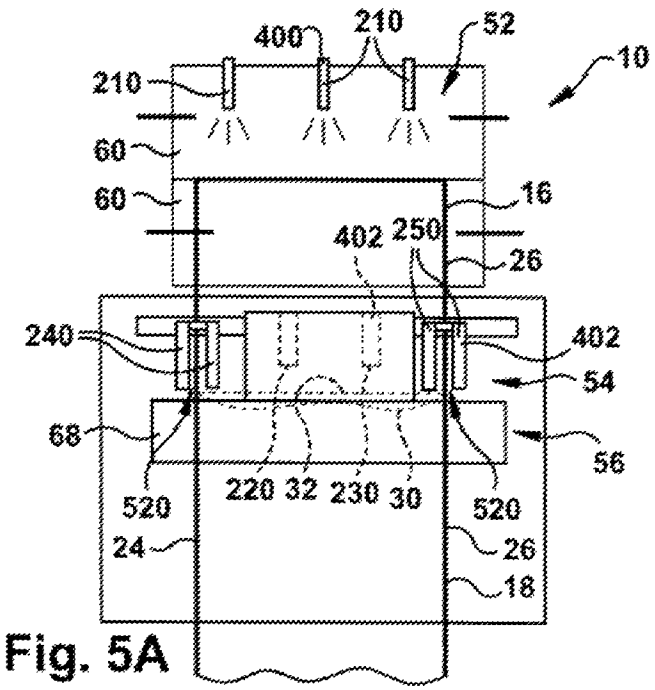
FIG. 5A is a front view of the apparatus showing the web opening being blown open above the bag engagement devices.
Figure 5B:
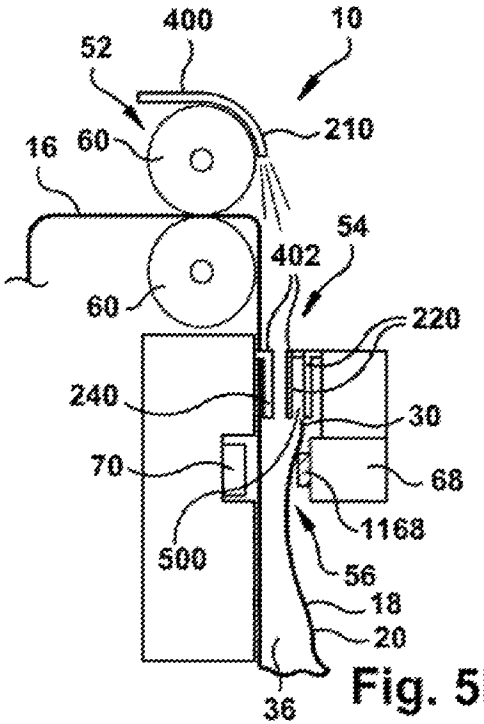
FIG. 5B is a side view of the apparatus and elongated web shown in FIG. 5A.

In an exemplary embodiment, the controller controls the engagement device to move the grippers 220, 230, 240, 250 from a closed position (See FIGS. 3A-3C) to an open position (See FIG. 4A-4C) once the opening 30 is positioned below the engagement device 402. Referring to FIGS. 5A-5C, the controller controls the blower 400 to blow air between the plies 20, 22 at the opening 30 of the bag. The air is forced between the plies through the opening 30 to inflate the bag 18. In an exemplary embodiment, the first ply 20 of the inflated bag 18 is generally aligned with or aligned with a gap 500 (see FIG. 5B) between the gripping members of each pair of open gripper 220, 230. In an exemplary embodiment, the edges of the inflated bag 18 are generally aligned with or aligned with a gap 520 (see FIGS. 5A and 5C) between the gripping members of each open pair of grippers 240, 250. In another embodiment, the bag 18 is not inflated but opened by other means just enough to allow the grippers 220, 230, 240, 250 to be inserted into the opening 30 of the bag.

Figure 6C:
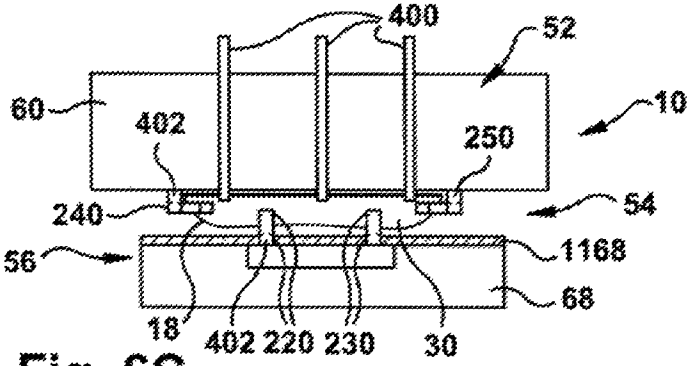
FIG. 6C is a top view of the apparatus and elongated web shown in FIG. 6A.
Figure 6A:
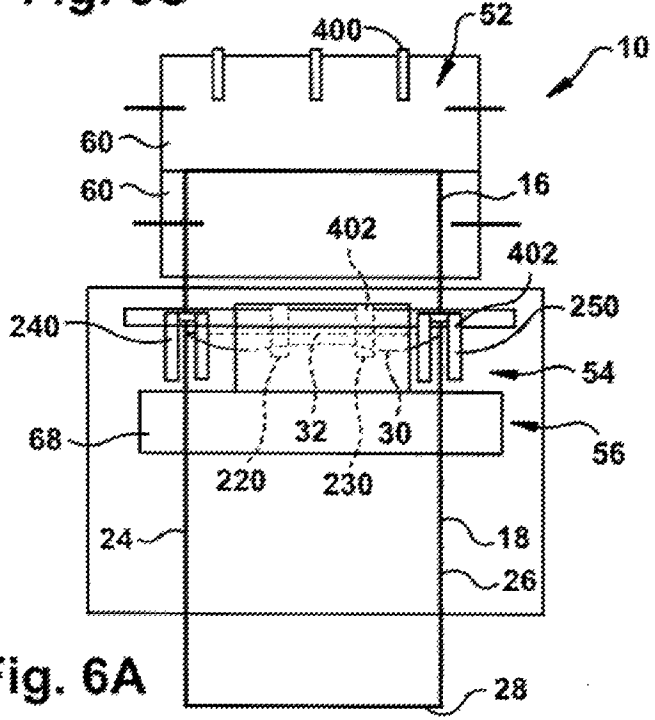
FIG. 6A is a front view of the apparatus showing the web being reverse indexed to position the bag engagement devices inside the web opening.
Figure 6B:
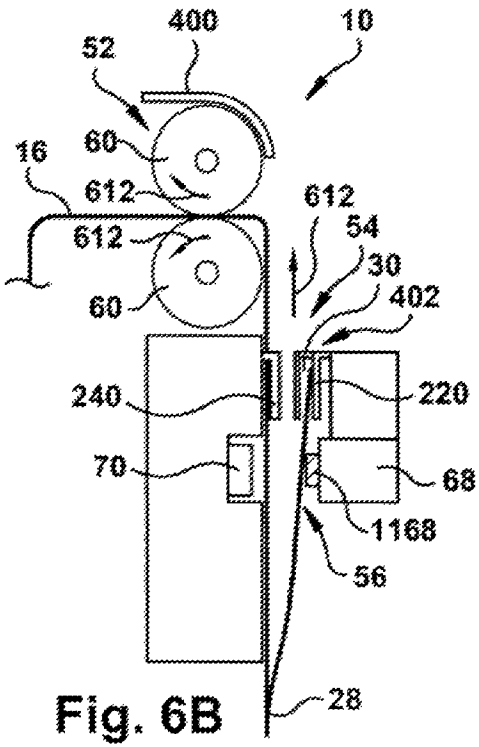
FIG. 6B is a side view of the apparatus and elongated web shown in FIG. 6A.

Referring to FIGS. 6A-6C, in an exemplary embodiment the controller 58 causes the indexing mechanism 52 to reverse index the web as indicated by arrow 612 while the pairs of grippers 220, 230 are open. The blower 400 may optionally be stopped during the reverse indexing. The reverse indexing pulls the first ply 20 of the bag 18 into the gap 500 between the gripping members of each pair of open grippers 220, 230. The reverse indexing also pulls the edges 24, 26 of the bag 18 into the gap 520 between the gripping members of each pair of open grippers 240, 250.

Figure 7C:
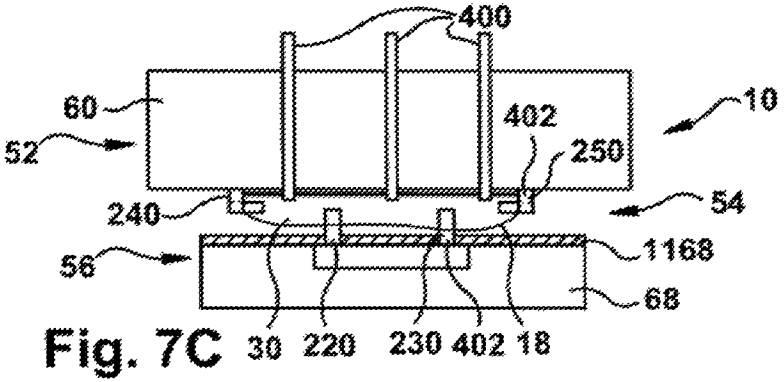
FIG. 7C is a top view of the apparatus and elongated web shown in FIG. 7A.
Figure 7A:
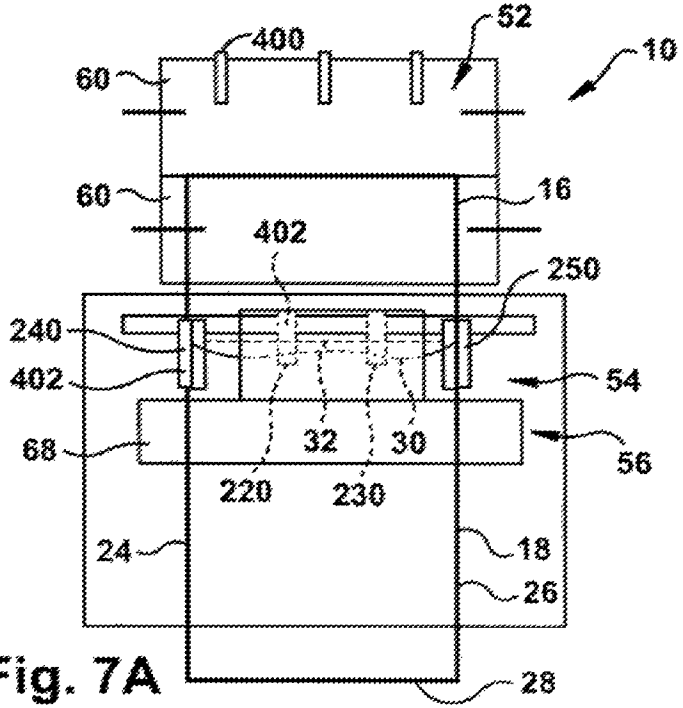
FIG. 7A is a front view of the apparatus showing bag engagement devices engaging a bag of the web at the opening.
Figure 7B:
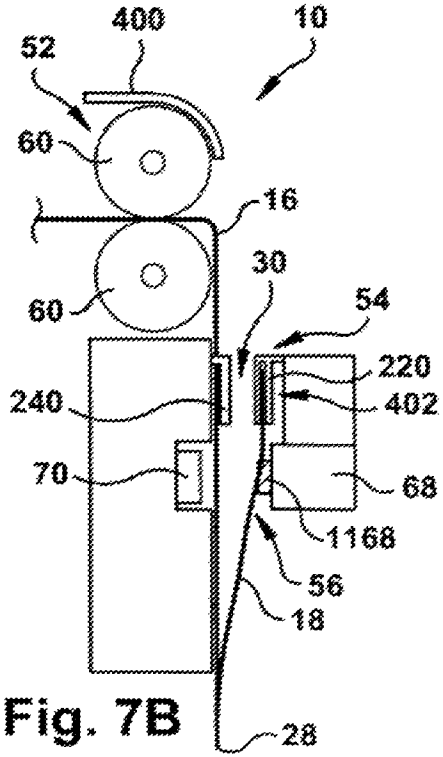
FIG. 7B is a side view of the apparatus and elongated web shown in FIG. 7A.

Referring to FIGS. 7A-7C, in an exemplary embodiment the controller 58 causes the pairs of grippers 220, 230, 240, 250 to move from the open position to the closed position. The first ply 20 of the bag 18 is gripped between the gripping members of each of the pairs of gripper 220, 230. The edges 24, 26 of the bag 18 are gripped between the gripping members of each pair of grippers 240, 250.

Figure 8C:
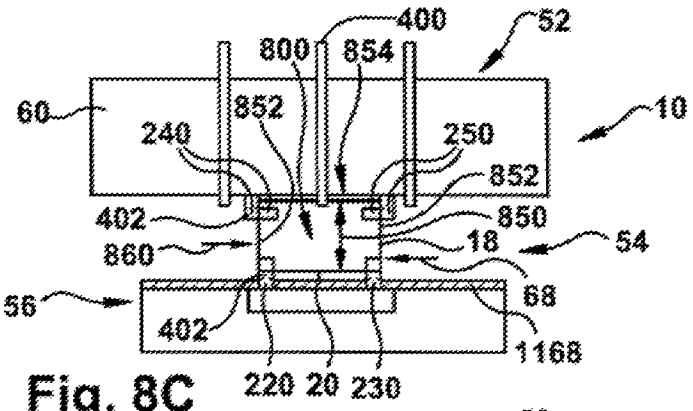
FIG. 8C is a top view of the apparatus and elongated web shown in FIG. 8A.
Figure 8A:
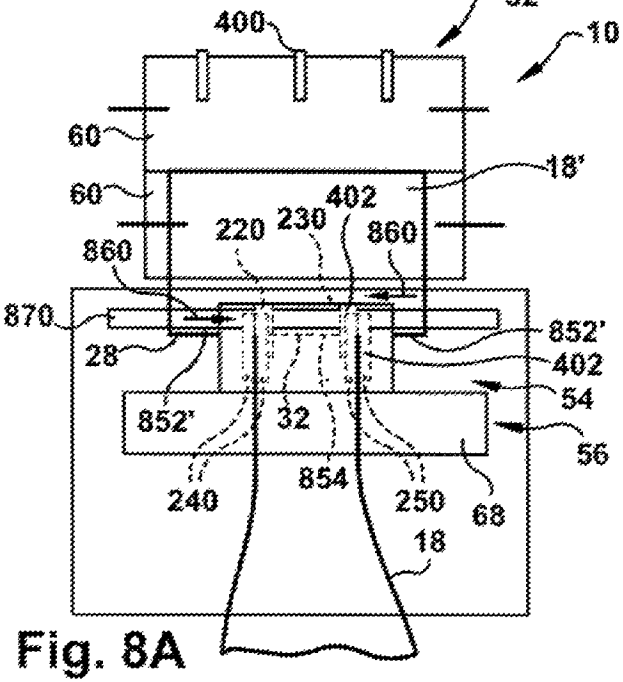
FIG. 8A is a front view of the apparatus showing the engagement devices moving to provide a rectangular bag opening.
Figure 8B:
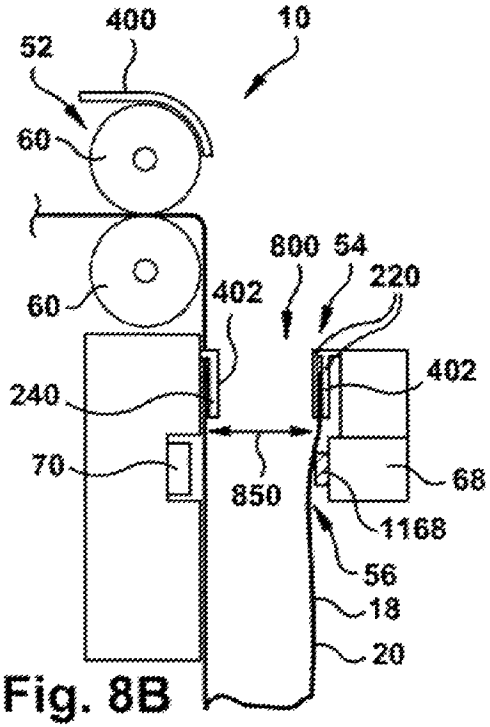
FIG. 8B is a side view of the apparatus and elongated web shown in FIG. 8A.
Figure 9C:
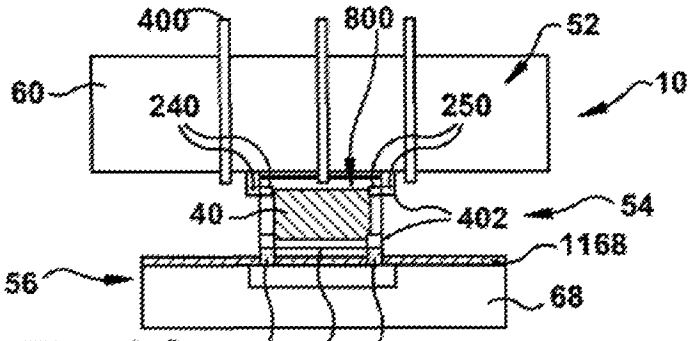
FIG. 9C is a top view of the apparatus and elongated web shown in FIG. 9A.
Figure 9A:
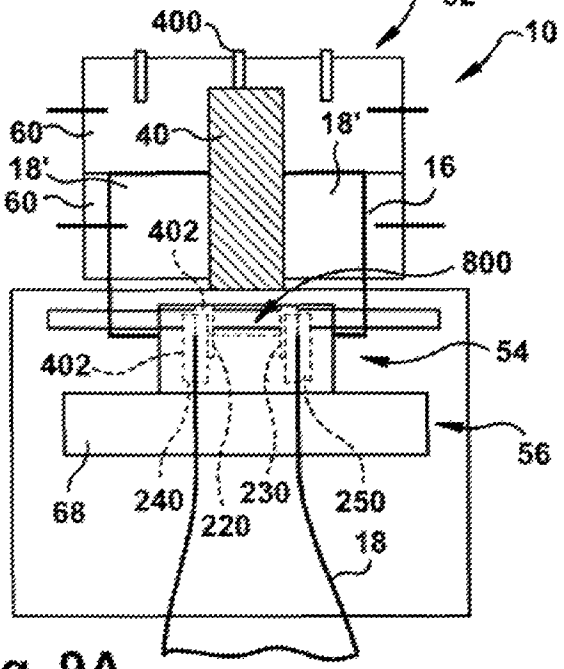
FIG. 9A is a front view of the apparatus showing a rectangular product positioned above the rectangular bag opening.
Figure 9B:
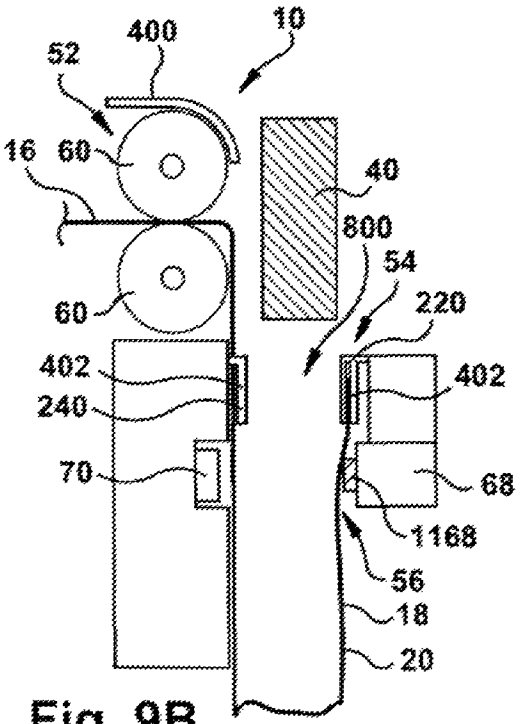
FIG. 9B is a side view of the apparatus and elongated web shown in FIG. 9A.
Figure 10C:
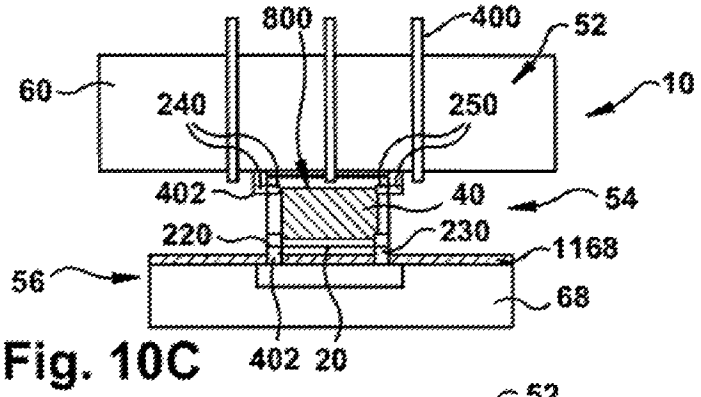
FIG. 10C is a top view of the apparatus and elongated web shown in FIG. 10A.
Figure 10A:
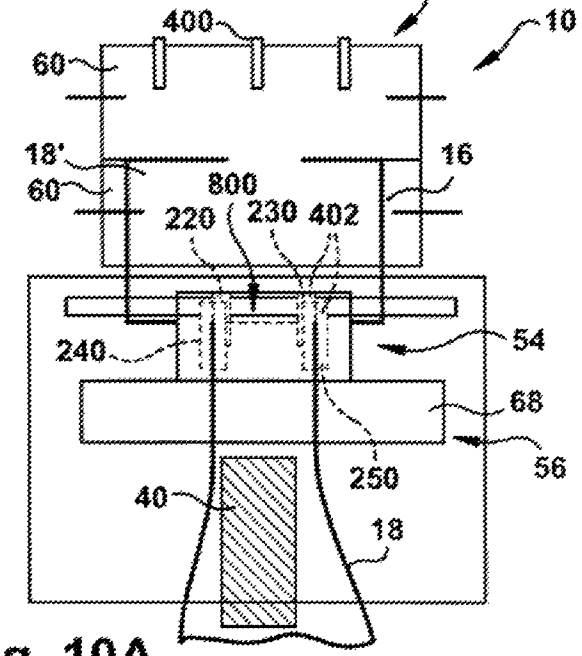
FIG. 10A is a front view of the apparatus showing a rectangular product positioned in the open bag.
Figure 10B:
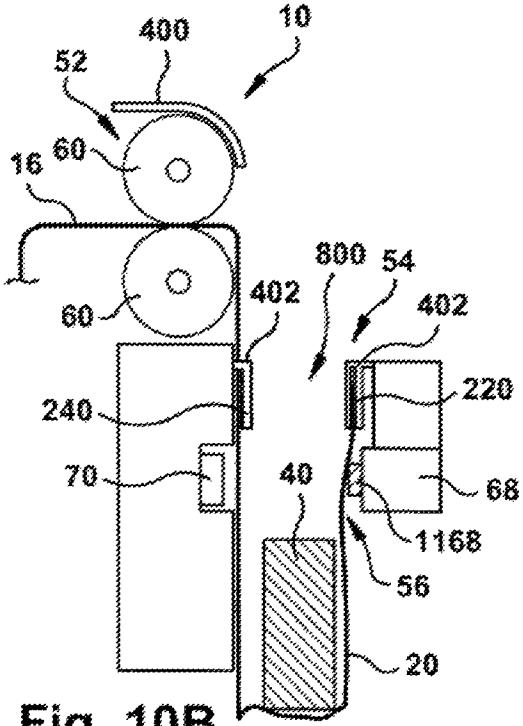
FIG. 10B is a side view of the apparatus and elongated web shown in FIG. 10A.

Referring to FIGS. 8A-8C, each bag 18 is provided with a rectangular opening 800 at a position where the bag is loaded with a product 40. Referring to FIGS. 8A-8C, in an exemplary embodiment, the controller controls the engagement device 402 to provide the bag 18 with the rectangular opening 800 for loading. In the illustrated embodiment, the pairs of gripping members 220, 230 move the first ply 20 away from the second ply 22 as indicated by arrows 850 (see FIGS. 8B and 8C). At the same time, the pairs of gripping members 240, 250 move the edges 24, 26 toward each other as indicated by arrows 860 (see FIGS. 8A and 8C). The movement of the pairs of gripping members 240, 250 tears the line of perforations 32 in the second layer 22. As such, edge portions 852 of the bag 18 are torn away from edge portions 852' of the next bag 18', allowing the rectangular opening 800 to be formed. In one exemplary embodiment, the second ply 22 slides between the pairs of gripping members 240, 250 as the pairs of gripping members 240, 250 move from the position illustrated by FIGS. 7A-7C to the position illustrated by FIGS. 8A-8C. A center portion 854 of the line of perforations 32 in the second layer 22 of the bag 18 remains in-tact. This leaves the bag 18 connected to the bag 18' while the bag 18 has the rectangular opening 800.

The pairs of gripping members 220, 230 can move the first ply 20 away from the second ply 22 in a wide variety of different ways. In the illustrated embodiment, the pairs of gripping members 220, 230 are attached to a bar 68 that is part of the sealing assembly 56. In this embodiment, the bar 68 moves the attached pairs of gripping members 220, 230. However, the pairs of gripping members 220, 230 can be moved by an actuator that is separate from the bar 68. The pairs of gripping members 240, 250 can move the edges 24, 26 toward each other in a variety of different ways. In the illustrated embodiment, the pairs of gripping members 240, 250 move in a slot 870 in a housing of the apparatus 10. The pairs of gripping members 240, 250 can be driven by a motor, a linear actuator or any other mechanism.

Referring to FIGS. 9A-9C and 10A-10C, the bag 18 is maintained with the rectangular opening 800 at the load position and the product 40 is loaded into the bag 18. The product may be loaded manually or automatically. In the illustrated embodiment, the position where the bag 18 is loaded is also the position where bag 18 is sealed after the rectangular opening 800 is closed. In another embodiment, the position where the bag is loaded is different than the position where the bag is sealed. In this embodiment, the controller causes the indexing mechanism 52 to move the bag 18 to the seal position after the bag is loaded with product 40 and closed.

In an exemplary embodiment, once the product is loaded in the bag 18, an operator may provide a signal to the controller that indicates that loading is complete or completion of loading may be automatically detected. The apparatus 10 may be configured to allow the operator to provide the completed loading signal to the controller in a wide variety of different ways. For example, the apparatus may have a control foot pedal (not shown) or the sealing arrangement 56 may have a portion that the operator can push on to indicate that loading is complete and it is time to seal the package. Similarly, the apparatus can be configured to automatically detect completed loading and provide the controller with a signal that indicated this fact. For example, the apparatus may include a counter or may weigh the package to detect completed loading.

Figure 11C:
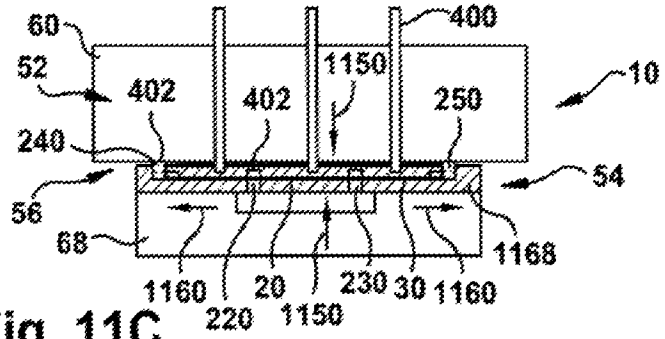
FIG. 11C is a top view of the apparatus and elongated web shown in FIG. 11A.
Figure 11A:
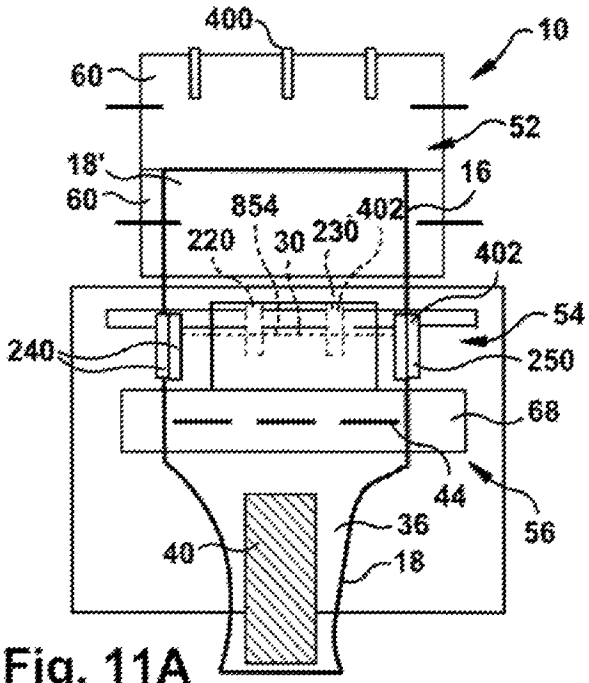
FIG. 11A is a front view of the apparatus showing the bag engagement devices moving to close the bag and the bag being sealed by a sealing arrangement of the apparatus.
Figure 11B:
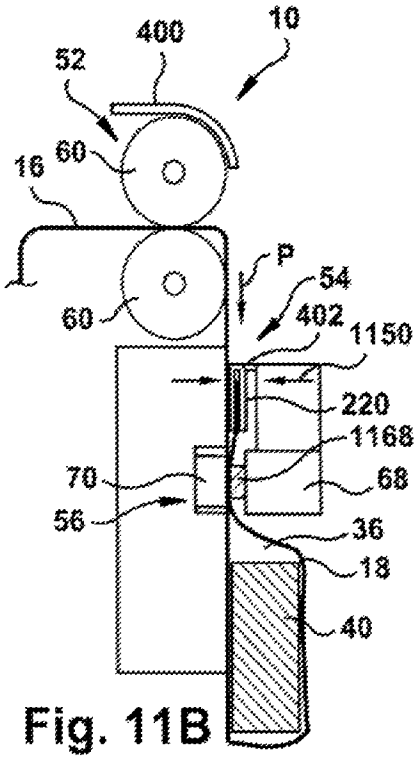
FIG. 11B is a side view of the apparatus and elongated web shown in FIG. 11A.

Referring to FIGS. 11A-11C, the signal from the operator or detection of completed loading is communicated to the controller, and causes the engagement device 402 to close the bag. In the illustrated embodiment, the pairs of gripping members 220, 230 move the first ply 20 back toward the second ply 22 as indicated by arrows 1150 (see FIGS. 11B and 11C). At the same time, the pairs of gripping members 240, 250 move the edges 24, 26 away from each other as indicated by arrows 1160 to close the bag opening 30 (see FIG. 11C). In an exemplary embodiment, the second ply 22 slides through each of the pairs of gripping members 240, 250 as the pairs of gripping members 240, 250 move from the position illustrated by FIGS. 10A-10C to the position illustrated by FIGS. 11A-11C. In the illustrated embodiment, the center portion 854 of the line of perforations 32 in the second layer 22 of the bag 18 remains in-tact. As such, the closed bag 18 remains connected to the bag 18'.

Still referring to FIGS. 11A-11C, the bag may be sealed at the position illustrated by FIGS. 11A-11C or the engagement device 402 may release the bag and the bag may be indexed to another position for sealing. In one exemplary embodiment, the bag is sealed while the engagement device 402 is holding the bag 18 closed. The sealing arrangement 56 is positioned along the path of travel P to provide the post formation seal 44. The sealing arrangement 56 may take a wide variety of different forms. For example, any mechanism that applies heat to the web to seal the first and second webs together to form the post formation seal 44 may be implemented.

In the illustrated embodiment, the sealing arrangement comprises a seal backing bar 68 and a heating element 70 that are that is selectively moved into and out of engagement. Referring to FIG. 11B, when the web is in the seal position, the controller controls the sealing arrangement 56 to clamp the web 16 between the seal backing bar 68 and the heating element 70. In an exemplary embodiment, the seal backing bar 68 comprises a rubber seal backing element 1168. The seal backing bar 68 may be moved to the clamped position (see FIG. 11B) from the unclamped position (See FIG. 10B) under a low force, such as a force that is lower than a force that could injure a finger that might be between the rubber seal backing element 1168 and the heating element 70. In addition, the rubber seal backing element 1168 is not heated.

In an exemplary embodiment, the heating element 70 is moved to the clamped position (See FIG. 11B) from the unclamped position (See FIG. 10B) and/or heat is applied by the heating element 70 only after the rubber seal backing element 1168 has been moved to the clamped position. Heat is applied to the web to seal the plies of the web together between the first side edge 24 and the second side edge 26. The heating element 70 may be continuously on (i.e. always hot when the machine is turned on) or the heating element 70 may be controlled to only apply heat when the bag 18 is clamped and/or a seal signal is provided by the controller. The first and second plies 20, 22 are sealed together to form the compartment 36.

Figure 12C:
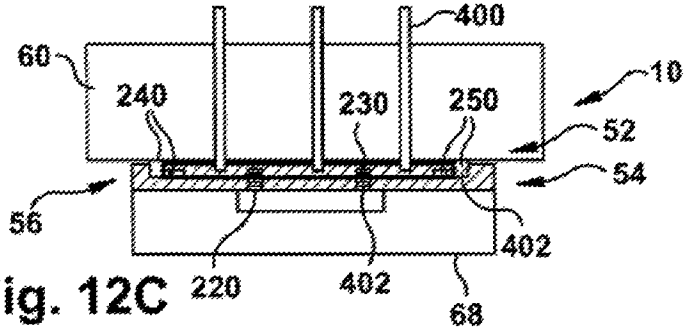
FIG. 12C is a top view of the apparatus and elongated web shown in FIG. 12A.
Figure 12A:
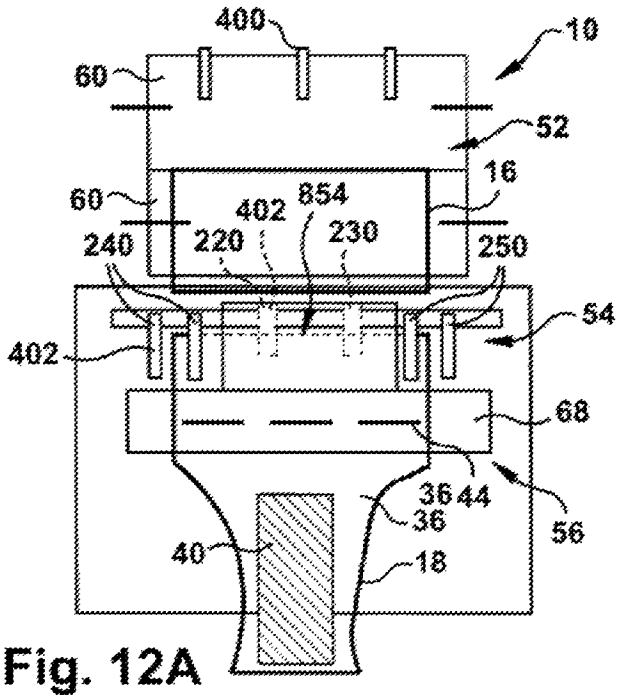
FIG. 12A is a front view of the apparatus showing reverse indexing of the web to separate the filled and sealed bag from the web.
Figure 12B:
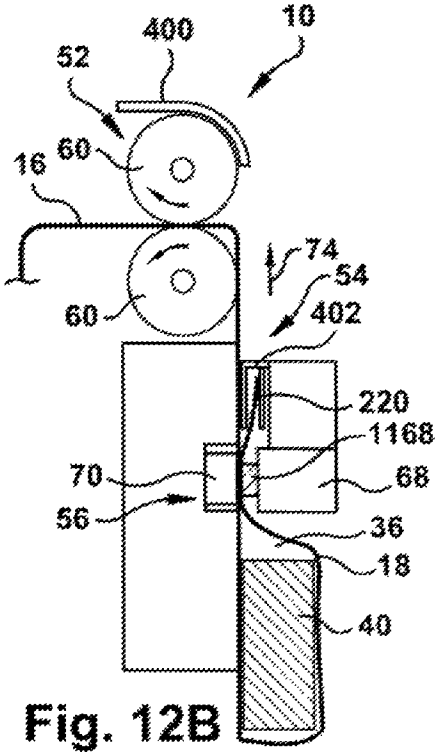
FIG. 12B is a side view of the apparatus and elongated web shown in FIG. 12A.

Referring to FIGS. 12A-12C, the engagement device 402 releases the bag. This release may be after the seal is formed or while the seal is being formed. This release may be before (see FIG. 12B) or after (see FIG. 13B) the seal backing bar 68 and a heating element 70 move apart from one another. In an exemplary embodiment, the controller causes the engagement device 402 to release the bag by causing the grippers 220, 230, 240, 250 to move from the closed position (FIGS. 11A-11C) to the open position (FIGS. 12A-12C).

Still referring to FIGS. 12A-12C, the controller controls the indexing mechanism 52 to separate the formed package 12 from the web 16. The second ply 22 is broken along the remaining middle portion 854 (the middle portion 854 is already broken off in the illustration of FIGS. 12A-12C) of the line of separation 32 to separate the package 12 from the elongated web 16. In the illustrated embodiment, the controller controls the indexing arrangement 52 to pull the web 16 away from the bag 18 as indicated by arrows 74 while the bag is clamped by the sealing arrangement 56 in an exemplary embodiment.

Figure 13C:
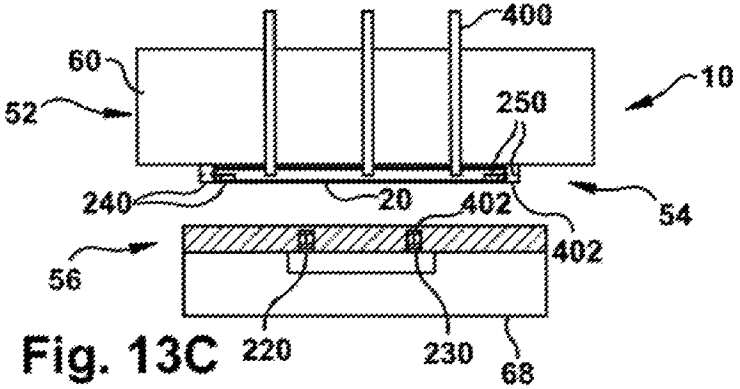
FIG. 13C is a top view of the apparatus and elongated web shown in FIG. 13A.
Figure 13A:
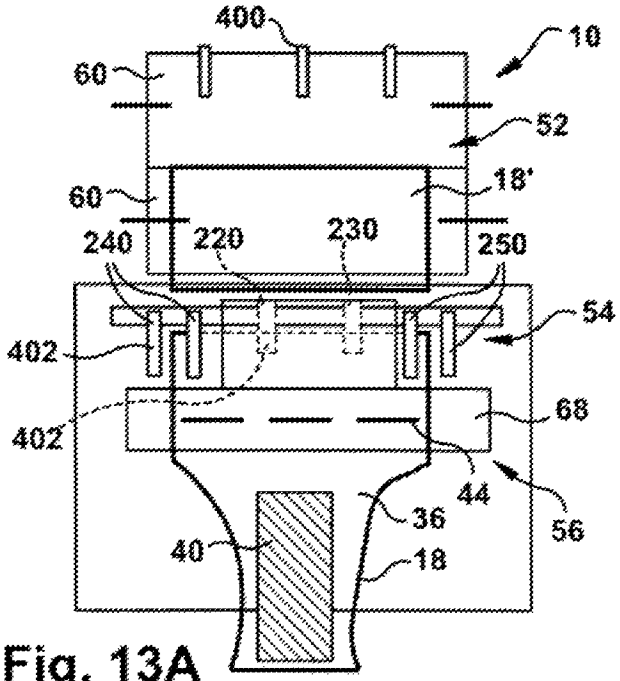
FIG. 13A is a front view of the apparatus showing releasing the filled and sealed bag from the apparatus.
Figure 13B:
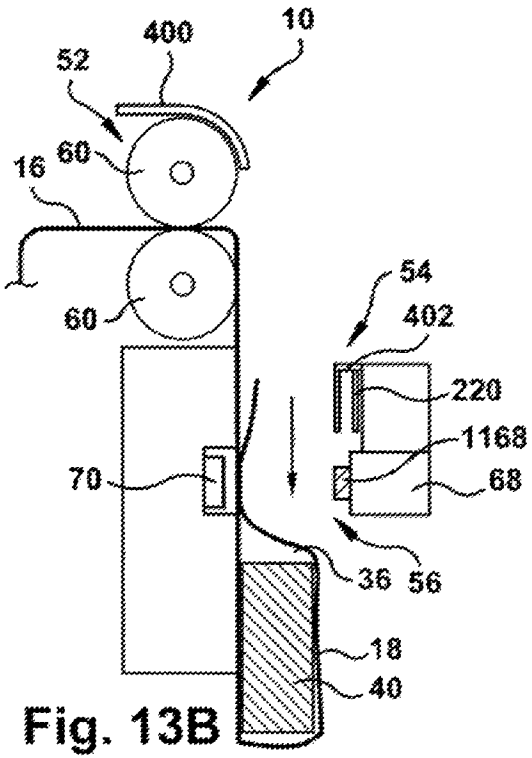
FIG. 13B is a side view of the apparatus and elongated web shown in FIG. 13A.

Referring to FIGS. 13A-13C, the controller controls the sealing arrangement 56 to release the formed package 12 after the filled bag 18 is separated from the next, unfilled bag 18'. In the illustrated embodiment, the formed package 12 is released by moving the seal backing bar 68 away from the heating element 70.

Referring again to FIGS. 3A-3C, the controller 58 indexes the web 16 with the opening 30 of the next bag 18 to the load position and the cycle begins again. The controller may repeat the method as required to produce as many packages are needed from the web.

The web 16 of includes side seals 21 parallel to and proximate the first and second side edges 24, 26. The side seals 21 have a width of about 0.030 inches to about 0.500 inches, such as, for example, 0.100 inches to 0.250 inches. However, the seals 21 may have any range of widths that are within the range of 0.030 inches to 1 inch (i.e. 0.223 to 0.250, 0.8 to 1.0, 0.24 to 0.26, etc., i.e. any sub-range). The relatively thick seals 21 increase the force required to tear a loaded and sealed bag from the remainder of the bags. It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

What is claimed is:

1. A web of preformed bags, comprising:

first and second layers joined together at first and second side edges;

a plurality of preformed seals extending between the first and second side edges, wherein the plurality of preformed seals includes a first preformed seal and a second preformed seal; and a plurality of lines of separation in the second layer extending between the first and second side edges, wherein the plurality of lines of separation includes a first line of separation and a second line of separation, wherein the first preformed seal is located between the first and second lines of separation, and wherein the second line of separation is located between the first and second preformed seals;

wherein a first preformed bag is defined by the first and second side edges and the first and second lines of separation, the first preformed bag including:

a first line of weakness located in the first layer and a second line of weakness in the second layer, wherein the first and second lines of weakness are arranged parallel to the first and second side edges and extend from the first line of separation across the first preformed seal, and a first gap in the first layer between the second line of separation and a starting point of the first line of weakness, the first gap having no perforations, wherein a length of the first gap is less than one-half of a bag length of the first preformed bag; and wherein the web further comprises a first post formation seal extending between the first and second side edges and through the first gap of the first preformed bag between the second line of separation and a starting point of the first line of weakness of the first preformed bag.

2. The web of claim 1, wherein the first preformed bag includes a second gap in the second layer between the second line of separation and a starting point of the second line of weakness of the first preformed bag, the second gap of the first preformed bag having no perforations.

3. The web of claim 1, further comprising:

a plurality of openings in the first layer extending between the first and second side edges, wherein the plurality of openings includes a first opening and a second opening, wherein the first preformed seal is located between the first and second openings, and wherein the second opening is located between the first and second preformed seals.

4. The web of claim 3, wherein the first opening is superposed over the first line of separation and the second opening is superposed over the second line of separation.

5. The web of claim 3, wherein the second opening is arranged such that a product can be loaded into the first preformed bag through the second opening.

6. The web of claim 1, wherein:

the plurality of preformed seals further includes a third preformed seal, wherein the second preformed seal is located between the first and third preformed seals;

the plurality of lines of separation further includes a third line of separation located between the second and third preformed seals; and a second preformed bag is defined by the first and second side edges and the second and third lines of separation, the second preformed bag including:

a first line of weakness located in the first layer and a second line of weakness in the second layer, wherein the first and second lines of weakness are arranged parallel to the first and second side edges and extend from the second line of separation across the second preformed seal, and a first gap in the first layer between the third line of separation and a starting point of the first line of weakness, the first gap having no perforations, wherein a length of the first gap is less than one-half of a bag length of the second preformed bag.

7. The web of claim 6, further comprising a second post formation seal extending between the first and second side edges and through the first gap of the second preformed bag between the third line of separation and a starting point of the first line of weakness of the second preformed bag.

8. The web of claim 6, wherein the first preformed bag includes a second gap in the second layer between the third line of separation and a starting point of the second line of weakness of the second preformed bag, the second gap of the second preformed bag having no perforations.

9. The web of claim 6, further comprising:

a plurality of openings in the first layer extending between the first and second side edges, wherein the plurality of openings includes a first opening, a second opening, and a third opening, wherein the first preformed seal is located between the first and second openings, wherein the second opening is located between the first and second preformed seals, and wherein the third opening is located between the second and third preformed seals.

10. The web of claim 9, wherein the first opening is superposed over the first line of separation, the second opening is superposed over the second line of separation, and the third opening is superposed over the third line of separation.

11. The web of claim 9, wherein the third opening is arranged such that a product can be loaded into the second preformed bag through the third opening.

12. A method comprising:

indexing a web of preformed bags along a path of travel in a packaging machine, wherein the web of preformed bags includes:

first and second layers joined together at first and second side edges;

a first preformed seal extending between the first and second side edges and a second preformed seal extending between the first and second side edges; and a first line of separation extending between the first and second side edges and a second line of separation extending between the first and second side edges, wherein the first preformed seal is located between the first and second lines of separation, and wherein the second line of separation is located between the first and second preformed seals;

wherein a preformed bag is defined by the first and second side edges and the first and second lines of separation, the preformed bag including:

a first line of weakness located in the first layer and a second line of weakness in the second layer, were the first and second lines of weakness are arranged parallel to the first and second side edges and extend from the first line of separation across the first preformed seal, and a first gap in the first layer between the second line of separation and a starting point of the first line of weakness, the first gap having no perforations, wherein a length of the first gap is less than one-half of a bag length of the preformed bag;

loading a product into the preformed bag; and forming a post formation seal between the first and second side edges and through the first gap of the preformed bag between the second line of separation and the starting point of the first line of weakness of the first preformed bag.

13. The method of claim 12, further comprising:

tearing the first line of separation and the second line of separation to separate the preformed bag from the web of preformed bags.

14. The method of claim 13, wherein the tearing of the first line of separation and the second line of separation occurs after the forming of the post formation seal.

15. The method of claim 12, wherein the preformed bag includes a second gap in the second layer between the second line of separation and a starting point of the second line of weakness of the first preformed bag, the second gap of the first preformed bag having no perforations.

16. The method of claim 15, wherein forming the post formation seal further comprises forming the post formation seal through the second gap of the preformed bag.

17. The method of claim 12, wherein the web of preformed bags further includes:

a plurality of openings in the first layer extending between the first and second side edges, wherein the plurality of openings includes a first opening and a second opening, wherein the first preformed seal is located between the first and second openings, and wherein the second opening is located between the first and second preformed seals.

18. The method of claim 17, wherein the first opening is superposed over the first line of separation and the second opening is superposed over the second line of separation.

19. The method of claim 17, wherein loading of the product into the preformed bag includes loading the product into the preformed bag through the second opening.

* * * * *